United States Patent [19]

Taylor et al.

[11] Patent Number: 5,044,186

[45] **Date of Patent: * Sep. 3, 1991**

[54] SYSTEM AND METHOD OF DETECTING ROLL POSITION IN A ROTARY STRAIGHTENER

[75] Inventors: Phillip G. Taylor, Hartville; Robert L. Bair, Canton, both of Ohio

[73] Assignee: Turner Machine Company, Salem, Ohio

[ * ] Notice: The portion of the term of this patent subsequent to Feb. 5, 2008 has been disclaimed.

[21] Appl. No.: 597,564

[22] Filed: Oct. 15, 1990

Related U.S. Application Data

[62] Division of Ser. No. 465,463, Jan. 16, 1990, Pat. No. 4,989,432.

[51] Int. Cl.[5] ..... B21D 3/04

[52] U.S. Cl. ..... 72/35

[58] Field of Search ..... 72/21, 35, 36, 98, 99

[56] References Cited

U.S. PATENT DOCUMENTS 3,358,485 12/1967 DeCaro et al. .
3,604,236 9/1971 Hyams .
4,471,639 9/1984 Gerber .

*Primary Examiner*—Lowell A. Larson
*Attorney, Agent, or Firm*—Body, Vickers & Daniels

[57] ABSTRACT

A system and method for detecting the exact position of the contoured, cross rolls in a multiple roll rotary straightener including provision of selected transverse and axial surfaces on the roll frames themselves and means for detecting the exact position of these surfaces whereby the rotary straightener can be returned to a preselected operating condition.

26 Claims, 8 Drawing Sheets

SYSTEM AND METHOD OF DETECTING ROLL POSITION IN A ROTARY STRAIGHTENER

This is a division of application Ser. No. 465,463 filed Jan. 16, 1990, now U.S. Pat. No. 4,989,432 granted Feb. 5, 1991.

The present invention relates to the art of rotary straighteners of the type using a series of spaced, cross rolls and more particularly to a system and method of detecting the position of the individual rolls in a rotary straightener.

INCORPORATION BY REFERENCE

As background information, U.S. Pat. No. 3,604,236 is incorporated by reference herein. This patent illustrates a rotary straightener having two groups of contoured rolls through which an elongated workpiece is driven for the purposes of straightening the workpiece.

DISCLOSURE

The present invention relates to a system and method of detecting the exact position of the individual cross rolls in a rotary straightener of the type having six rolls, with each roll mounted on a cylindrical roll frame supported in a matching, concentric cylindrical .cavity on the housing of the straightener. This new system and method will be described with particular reference to use in a six roll straightener; however, it is appreciated that the invention has broader applications and may be used for detecting the exact angular and/or axial position of individual rolls in various rotary straighteners. When operating a rotary straightener of the cross roll type, as shown in prior patent U.S. Pat. No. 3,604,236, it is necessary to adjust the individual rolls in an angular direction to accommodate various workpieces being processed by the straightener. Each time a different product or workpiece is being processed, the several rolls must be adjusted to accommodate the particular workpiece being processed. These roll positions change for different products. In the past, it has required extreme skill of the operator and considerable down time to adjust each roll for successive workpieces being processed. After an operator sets up the straightener for a particular workpiece, the rolls are locked in position by locking the position of the many roll frames upon which the rolls are mounted.

The fixed positions of the rolls are the same for subsequent runs of the same workpiece. Consequently, operators have developed several techniques for determining the positions of the rolls in an angular direction and, when necessary, in the appropriate axial direction for workpieces to be repeatedly processed in a given machine. The more common of these techniques has involved, placing marks upon the machine housing to indicate the positions of the various threaded screw down devices. Such prior techniques have been operator sensitive and could not be employed successfully by different operators. In addition, even with marks and other types of indication regarding the screw down positions, there was always a necessity for finally adjusting the rolls after the preselected positions of the rolls were reached.

Certain fine manipulation and operator adjustments were needed to process the next workpiece. Such primitive approaches to returning the rolls to their desired positions for rerunning a workpiece have not been considered acceptable for operating rotary straighteners.

Thus, substantial effort and money has been devoted to automating systems for readjusting the rolls in an angular direction and, when necessary, in an axial direction for running a particular elongated workpiece through the rotary straightener. The most successful of these prior attempts to reduce the time necessary for readjusting the rolls in a rotary straightener have involved the mere application of microprocessor technology to the prior efforts used by operators for returning the rolls to the desired axial and angular positions. Such systems still involve the measurement of the positions of the roll adjusting devices on the machine to determine the positions into which the rolls are to be adjusted for a given product. Some of the more sophisticated attempts have used resolvers to detect the angular position of the threaded devices and the conversion of the resolver output for the various threaded devices or gear arrangements to return all rolls to desired positions for running a preselected product.

All prior attempts to mechanize the manual procedure for adjusting the positions of the rolls in a straightener have been quite expensive and generally unacceptable. Total accuracy and repeatability for the six angular and four vertical positions of the rolls has not been obtained. With these expensive efforts to mechanize the set up procedure, there was still a need for final adjustment of the rolls before a product could be run. Due to the expensive nature of prior attempts to mechanize the adjustment of the rolls during set up, most rotary straighteners still require a considerable degree of artistry on the part of the operator and varying amounts of trial and error for changing from one product to the next. These expensive adjustment systems have not been successful. In addition, such complex and expensive systems can not be applied to existing rotary machines. These machines vastly outnumber new machines now being manufactured. These prior efforts to mechanizing set up, even those employing microprocessor technology, have required recalibration before each set up and have been flawed due to certain mechanical hysteresis in the adjustment mechanisms used for the various rolls.

THE PRESENT INVENTION

The disadvantages of the prior manual approaches to set up for product changes in a rotary straightener and the expensive microprocessor adaptation of these approaches have been completely overcome by the present invention, which allows readjustment of the various individual rolls to set up for a different product. The invention provides a digital readout that indicates the precise angular positions and vertical positions of the cross rolls which readout involves the exact positions of the various rolls and not the positions of intermediate, secondary mechanisms. By using the present invention, once a proper set up is determined for a particular product being straightened, the digital readout values for each of the ten parameters are recorded. The next time that the same product is to be processed by the straightener, the straightener set up can be precisely duplicated by resetting the machine to the various recorded parameters in digital numbers. In accordance with the operation of the present invention, the machine set up requires no more than ten minutes. In many instances the machine set up requires less than five minutes. This set up time has heretofore been substantially greater than one hour. Not only does the invention allow rapid set up, which has heretofore been possible only with microprocessors, but the set up is precise and the workpiece can be processed without subsequent trimming by an operator. By employing the present invention, there is no need for recalibration. The roll set up is accurate and repeatable. Indeed, if an operator finds that a precise setting for a given workpiece should be adjusted slightly to further perfect the processing of that workpiece, the next run of that particular workpiece can be accurately and repeatedly set to the new exact roll positions. Thus, when employing the present invention, even when acceptable settings have been employed for a given workpiece the settings can be further improved and repeatedly employed for subsequent processing of the same product. This is a substantial advantage not heretofore realized in even microprocessor adaptation in new rotary straighteners.

In accordance with the present invention, there is provided a system for detecting the exact operating positions of the individual cross rolls of a rotary straightener including a series of cross rolls, each mounted on its own cylindrical roll frame. Each roll and frame is adjusted in an angular direction and, in some instances, in an axial direction with the frame moving in a cylindrical cavity of the housing forming the straightener. There is provided a first abutment surface means on each roll frame. This abutment means is a surface movable in a given direction about the central axis of the roll frame as the roll frame is rotated in the support cavity of the housing. The position of this first abutment surface indicates the exact angular position of the roll frame itself. The cylindrical roll frames that are to be adjusted in an axial direction have a second abutment surface means on the frame itself. This abutment means is a second surface movable in a given axial direction relative to the housing of the straightener as the roll frame is moved into and out of the support cavity of the housing. The position of this second surface on the roll frame is indicative of the exact axial position of the frame with respect to the cavity of the housing. Thus, two surfaces are provided on the housing themselves. These two surfaces coact with individual linear transducer means which detect the position of both first and second abutment surfaces with respect to the housing of the straightener. These transducers include a member which is linearly movable by one of the surfaces provided on the roll frame to create a voltage output that is indicative of the linear position of the movable member of the transducer. By converting the output voltages of the various transducers into digital numbers, these numbers indicate the exact positions of the two surfaces on the individual roll frames with respect to the housing of the straightener. By employing this system, the combination of a linear transducer coacting with surfaces on the roll frame itself solve all of the difficulties experienced in prior expensive attempts to employ microprocessing technology to determine the roll positions of the individual rolls in a straightener. By using the digital numbers indicative of the exact positions of one or two surfaces on each roll frame, each roll frame can be returned to an exact operating position duplicating the operating position desired for a given product. By employing linear variable differential transformers as the linear transducers (LVDT), the exact position is determined by a voltage level output. These transducers are sold by Schlumberger Industries of West Sussex, England. A digital indicator for the LVDT transducer is a Sirius readout manufactured by the same company. By employing a linear transducer and one or two surfaces on each roll frame, the exact position of each frame can be duplicated within the tolerance of the linear transducer. This system using a moving surface on the frame and an accurate, linear transducer which provides a voltage indicative of the position of the surface results in repeatability. There is no need for calibration or rezeroing of the digital readout. This combination of elements reduces any mechanical hysteresis, such as introduced by gear and screw threads or by pressure sensing transducers. Since the position of each surface on the roll frame itself is converted to a voltage, that is further converted into a digital number, the digital output number can be dimensionless. However, the number is repeated without requiring special operator skill. There is no need to create a target position toward which the actual roll position is adjusted as in a system using an error amplifier to adjust the position of the rolls. Even using an error amplifier or microprocessing technology or a combination thereof, the expense and accuracy is not acceptable, whereas the present invention has proven to be inexpensive, accurate and repeatable.

In accordance with another aspect of the present invention, there is provided a method of detecting the exact operational position of the cross rolls in a rotary straightener. This method involves the steps of providing a transversely facing surface on the roll frame itself, providing an axially facing surface on the roll frame itself, creating a voltage indicative of the exact position of the transverse surface with respect to the housing of the straightener, creating a voltage indicative of the exact position of the axially facing surface with respect to the housing of the straightener, and converting these voltages into digital numbers indicative of the exact positions of the surfaces with respect to the housing.

Both the system and method can be employed with a microprocessor and with servo feedback mechanisms to fully automate machine set up.

The primary object of the present invention is the provision of a system and method for detecting the exact operative positions of the cross rolls in a rotary straightener, which system and method allow repeated, accurate positioning of the rolls for processing a selected product.

Yet another object of the present invention is the provision of a system and method, as defined above, which system and method allow the cross rolls to be set to the same position to determine the proper processing of a product without the need for unusual skill of the operator.

Another object of the present invention is the provision of a system and method, as defined above, which system and method are superior to the prior microprocessing technology which employed transducers, such as pressure transducers and/or resolvers needing zeroing and/or calibration.

Still another object of the present invention is the provision of a system and method, as defined above, which system and method can be retrofitted onto existing rotary straighteners at a relatively low cost, while also being applicable to newly manufactured rotary straighteners.

Another object of the present invention is the provision of a system and method, as defined above, which system and method allow accurate, repeated set up of the roll positions in a rotary straightener, without requiring exceptional operational skills and/or experience.

Still a further object of the present invention is the provision of a system and method, as defined above, which system and method do not employ resolvers, pressure sensors and other transducers which require zeroing and calibration for accurate operation.

Still another object of the present invention is the provision of system and method, as defined above, which system and method employ linear transducers of the linear variable differential transformer type coacting with surfaces on the roll frame itself for detecting the exact position of the rolls.

The term "exact position" indicates direct readability of the position of the roll frame without intermediate mechanical devices, such as gears, threads, etc.

Thus, a primary object of the present invention is the provision of a system and method wherein the exact position of the roll frame is converted into a digital readout by implementation of a movable surface, in combination with a highly accurate linear transducer which is, in the preferred embodiment, a linear variable differential transformer type transducer. The readout can be used manually or in a closed loop system.

These and other objects and advantages will become apparent from the following description taken together with the drawings of this specification.

PREFERRED EMBODIMENT

Figure 1:
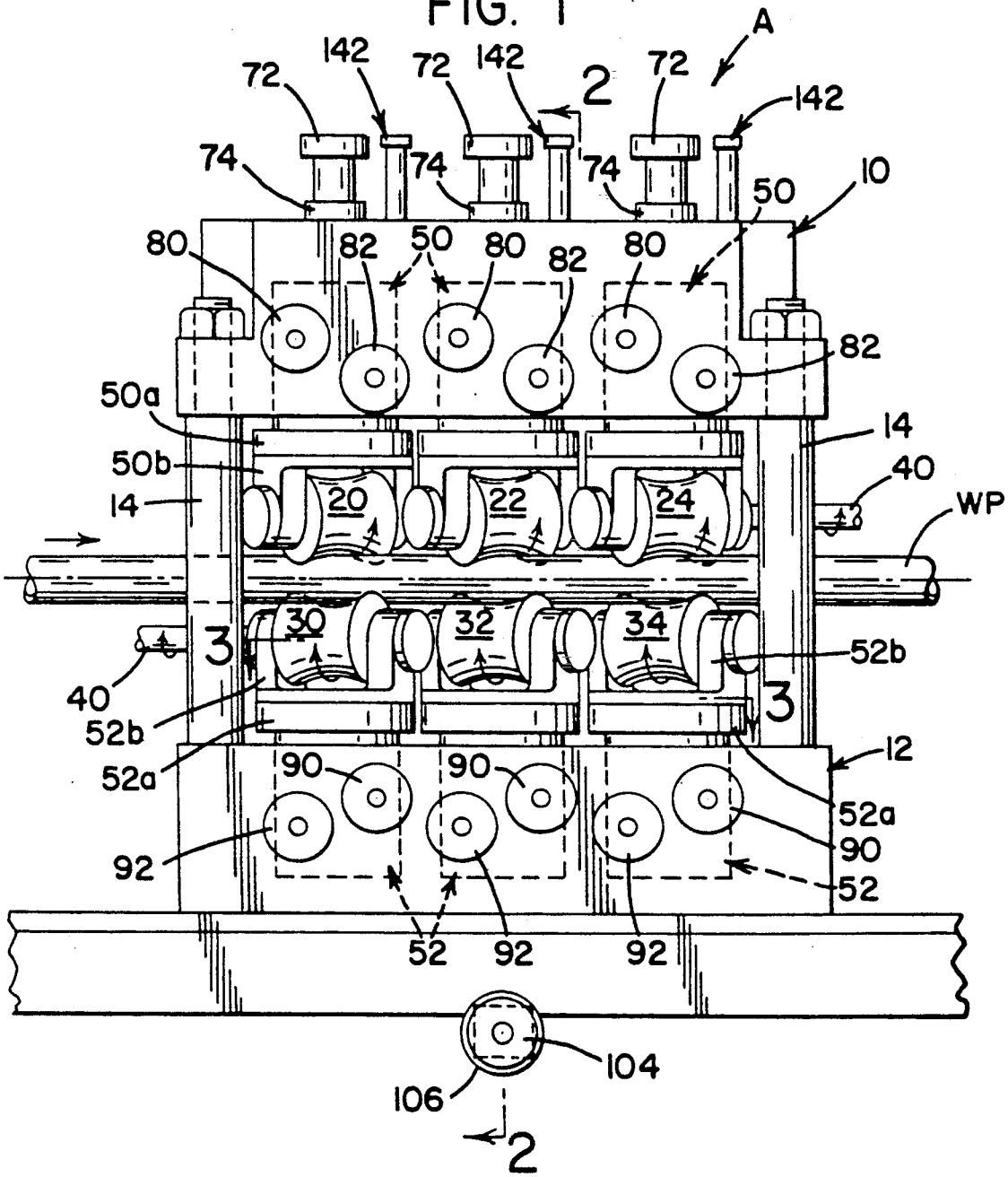
FIG. 1 is a front elevational view of a rotary straightener employing one embodiment of the present invention.
Figure 2:
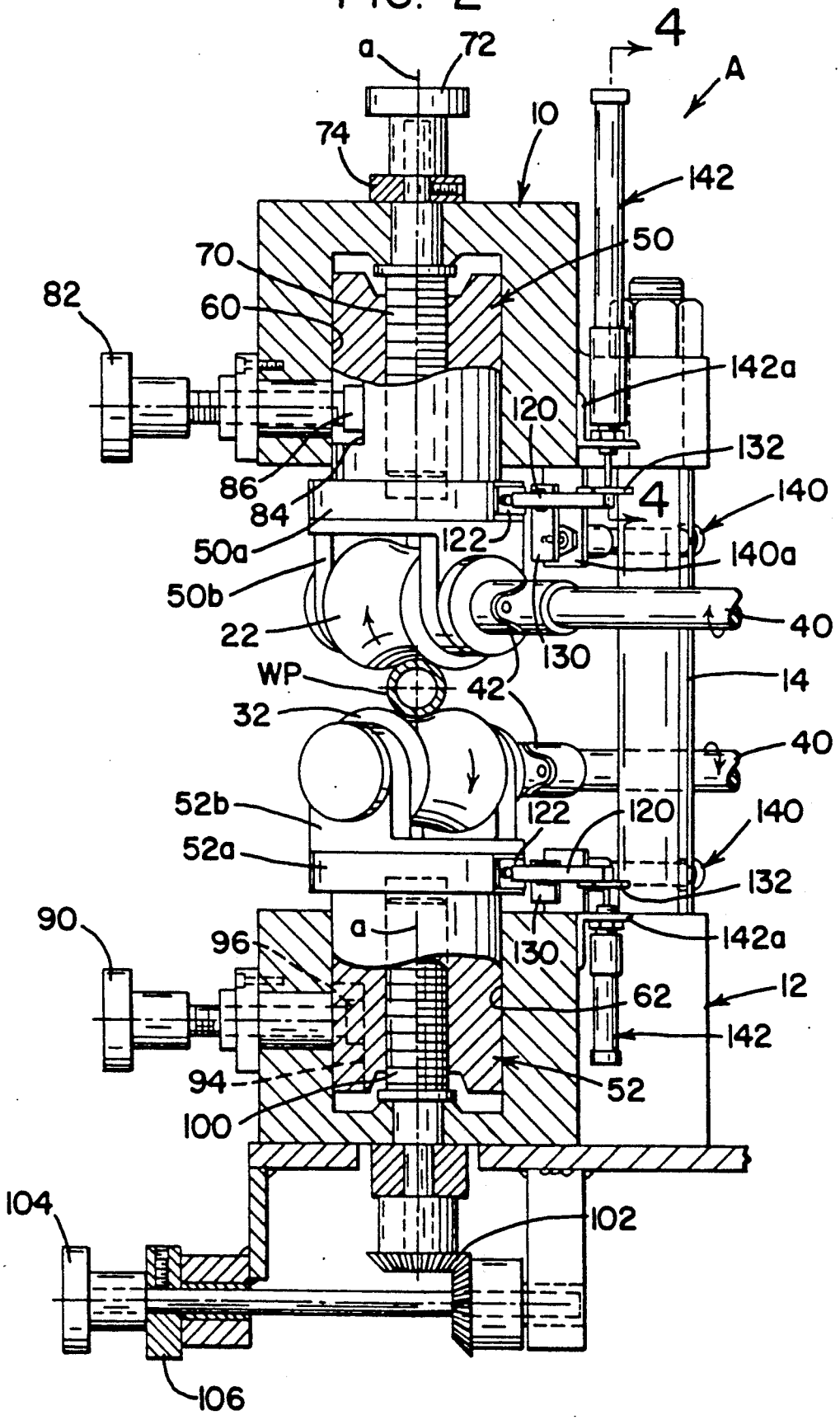
FIG. 2 is an enlarged, partially cross sectioned view taken generally along line 2—2 of FIG. 1.
Figure 3:
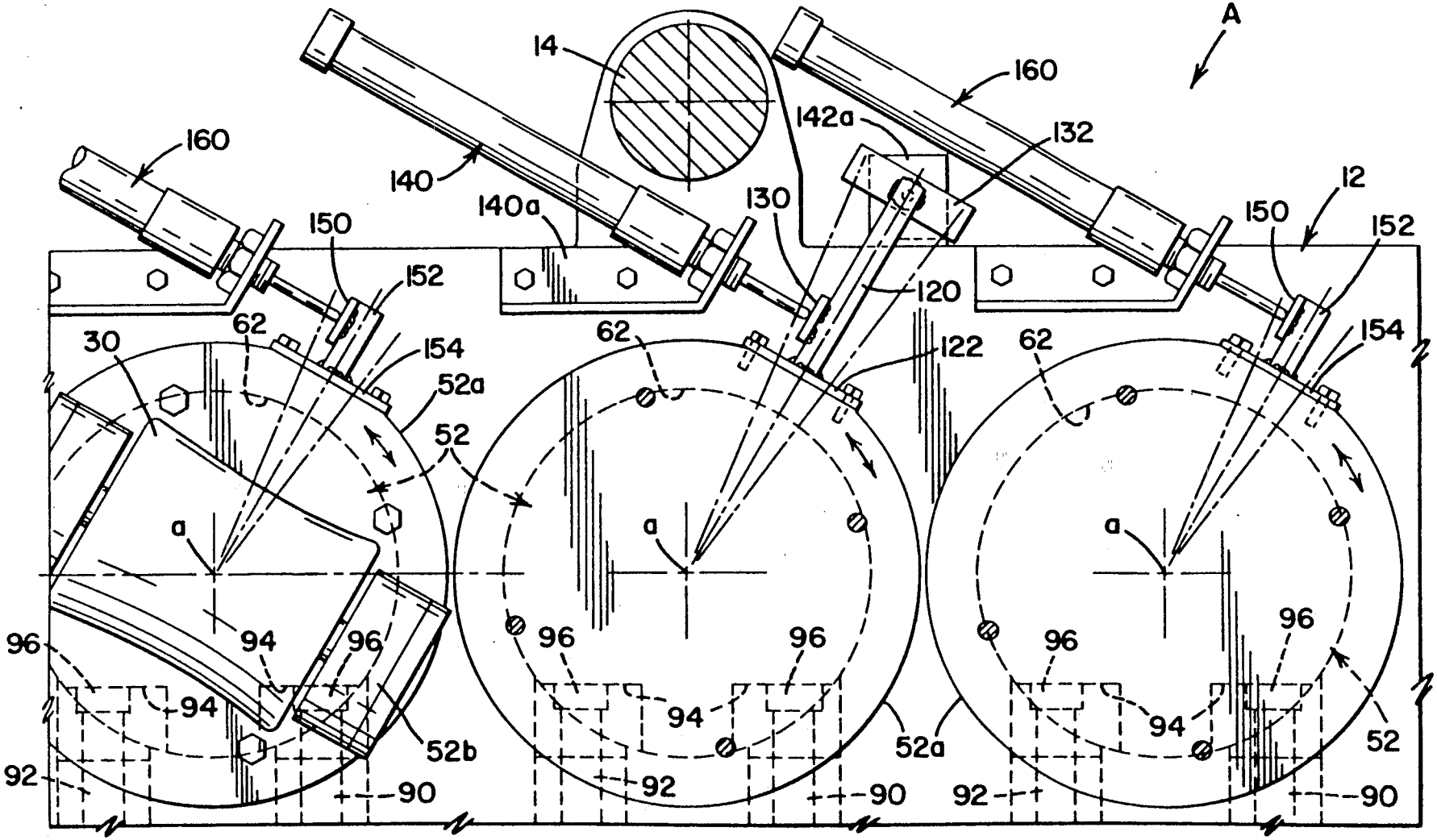
FIG. 3 is a partial, enlarged view taken generally along line 3—3 of FIG. 1.
Figure 7:
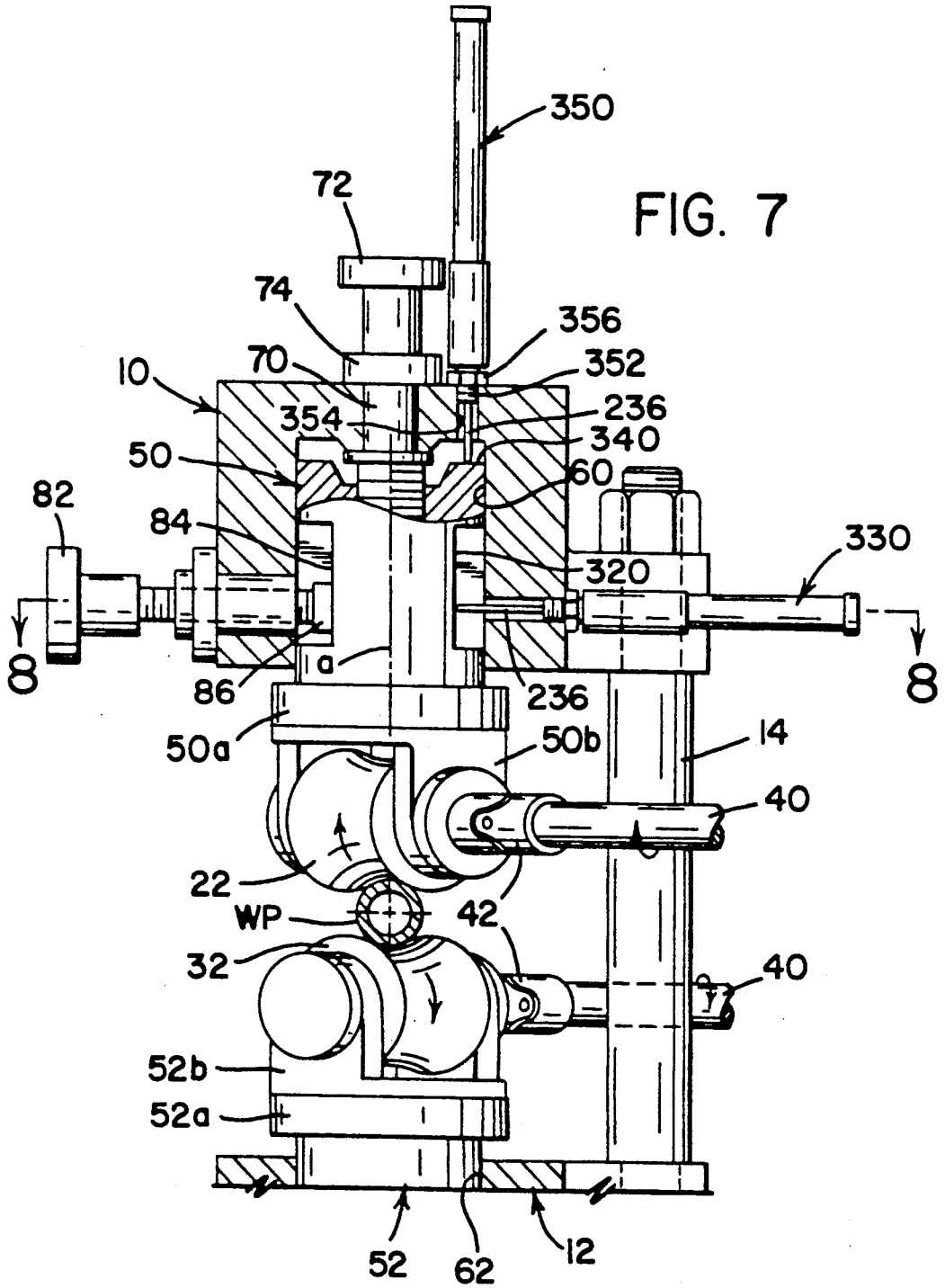
FIG. 7 is a cross sectional view somewhat similar to FIG. 2 illustrating a modification of the present invention specially adapted for use on a new machine.
Figure 8:
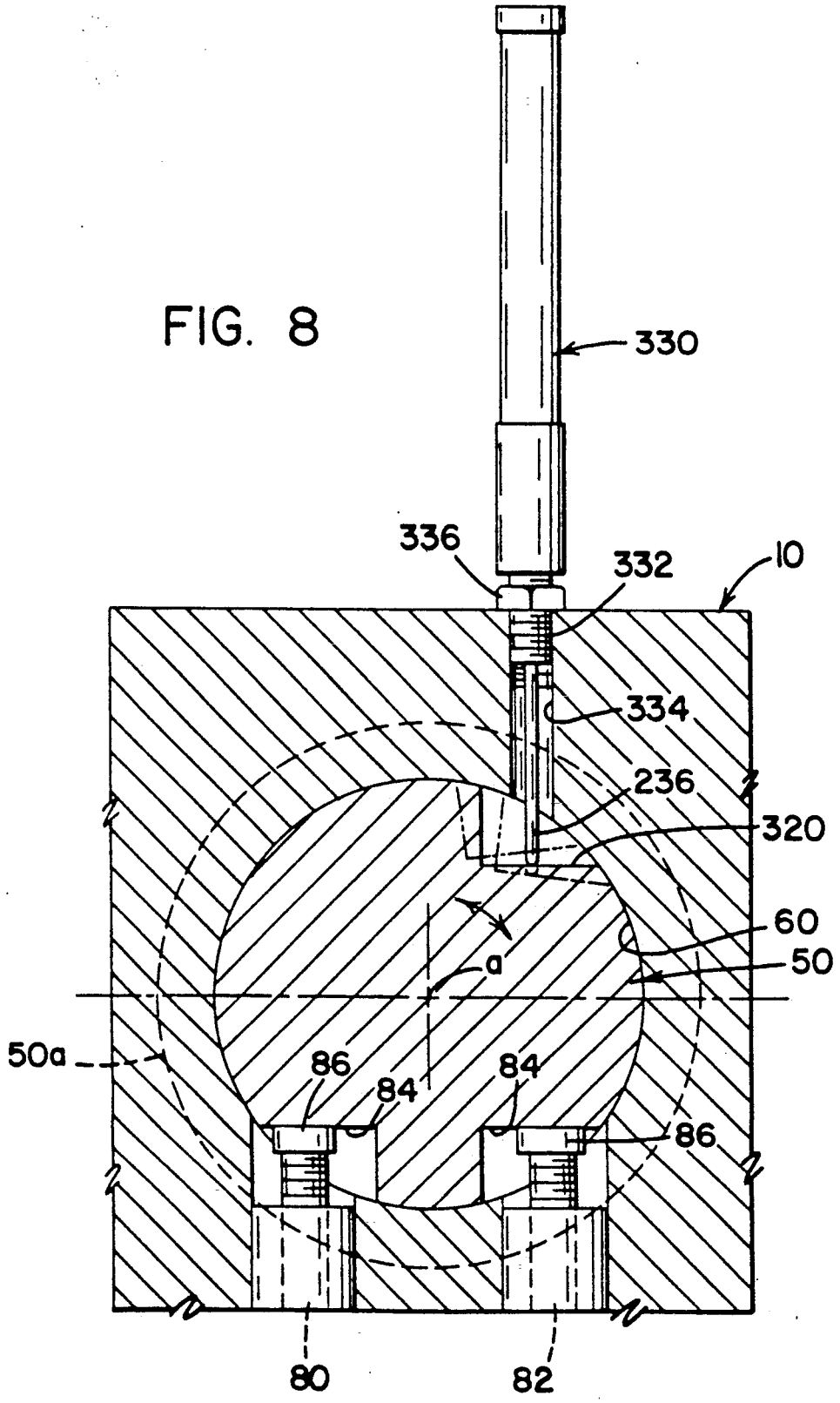
FIG. 8 is an enlarged cross sectional view taken generally along line 8—8 of FIG. 7; and, FIG. 9 is a block diagram illustrating the selector switch and analog to digital readout device employed in the preferred embodiment of the present invention.

Referring now to FIGS. 1-3, a somewhat standard rotary straightener A is illustrated as including an upper housing 10 and a lower housing 12 held together by appropriate tie rods 14 for processing a product for workpiece WP. A set of upper contoured, cross rolls 20, 22, 24 are positioned opposite to a lower set of contoured cross rolls 30, 32 and 34 in accordance with standard practice. Drive shafts 40 drive rolls 20, 22 and 24 and 30, 32 and 34 through appropriate universal joints 42. Each cross roll is supported by a somewhat standard arrangement including an upper cylindrical frame 50 and a lower cylindrical frame 52. Upper roll frames 50 each include a support shoulder **50*a* and a roll supporting trunnion 50*b*. In a like manner, lower cylindrical frames 52 each include shoulder 52*a* and a roll supporting trunnion 52*b*. The trunnions allow the rolls to be rotated by shafts 40 for driving workpiece WP through straightener A. A set of upper cylindrical cavities 60 in housing 10 receive frames 50 in a manner allowing both axial movement and radial adjustment. In a like manner, lower cylindrical cavities 62 in housing 12 support the lower roll frames 52 for axial movement along a central axis a and rotation about this central axis. As best shown in FIG. 2, each roll frame has an upper screw down 70 with a handle 72 and an indicator 74. Rotation of the screw down moves and fixes frame 50 along axis a in cavity 60. To adjust the angular position of frame 50 in cavity 60, there is provided two spaced adjustment and fixing screws 80, 82 each coacting with a recess 84 in frame 50 by way of an adjustment ram 86. The relative adjustment between screws 80, 82 and the engagement of their rams 86 with the recesses 84 as shown in FIGS. 2, 7 and 8; determines and fixes the angular position of roll frame 50 with respect to the cylindrical cavity 60. Frame 50 is movable within cavity 60; however, the tolerance is fairly close. This maintains the final adjusted positions of the rolls. Lower frame 52 is angularly adjusted and fixed by screws 90, 92 coacting and engaged with spaced recesses 94 through adjusting rams 96, as shown in FIG. 2. As so far described, all upper frames 50 can be moved in a vertical direction and fixed along axis a and rotated and fixed in an angular direction around this axis. Lower frames 52 can be adjusted and fixed in the angular direction and fixed. Only the center roll 32 in the lower set is adjusted in a vertical direction along axis a. This is accomplished by screw mechanism 100 operated through a gear set 102 rotated by handle 104. Indicator 106 can be employed to determine the position of handle 104**.

Figure 5:
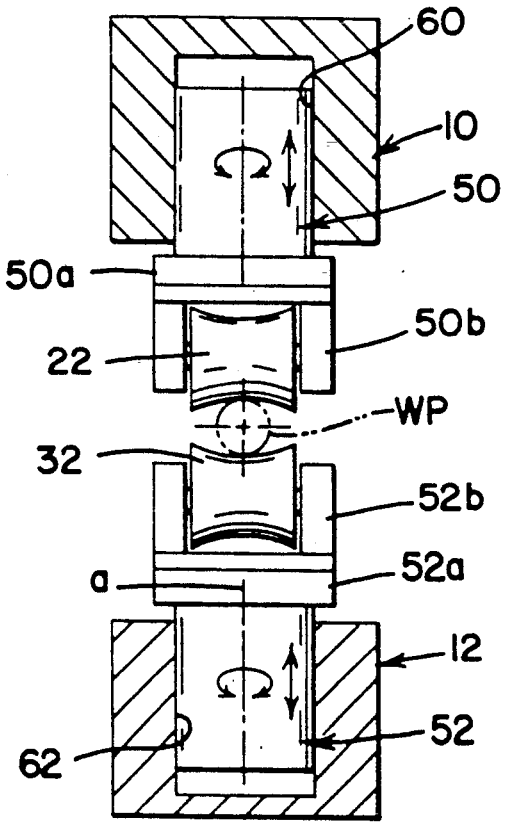
FIGS. 5 and 6 are schematic views showing adjustments made in the rollers of a rotary straightener to which the present invention is applicable.
Figure 6:
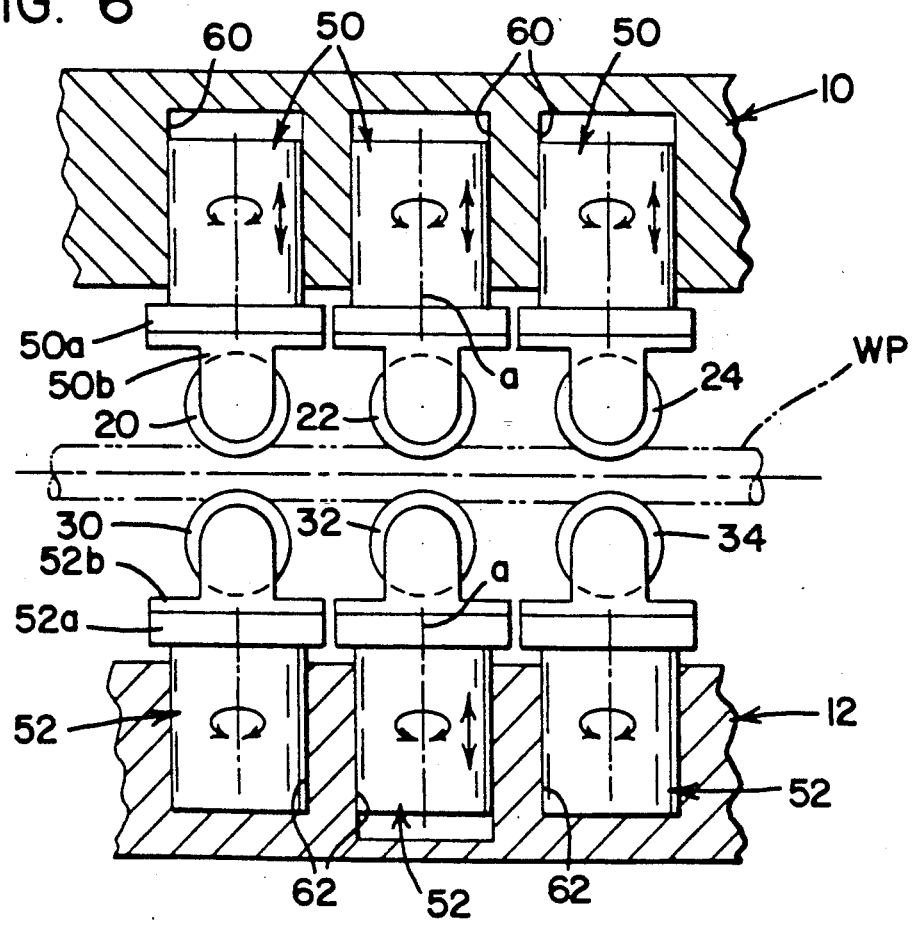

As so far explained, rotary straightener A is operated in accordance with standard technology and the vertical and angular positions of the individual roll frames are adjusted by known mechanisms. As shown in FIGS. 5 and 6, the upper frames are rotated and translated. The lower frames are rotated to match the upper frames so that the two sets of rolls are coordinated to different sized products. To adjust the processing offset, center, lower roll 32 is adjusted axially in a coordinated fashion with upper, center roll 22. This adjustment causes the appropriate straightening of workpiece WP. This procedure is in accordance with standard practice.

Apparatus A is provided with a new system and method to determine the exact position of rolls 20, 22, 24 and 30, 32, and 34 by a detecting concept involving surfaces provided directly on roll frames 50, 52. The support frames for rolls 20, 22, 24 and 34 each involve essentially the same detecting structure to detect both the axial position and the angular position of the frames. One of these structures formed in accordance with the preferred embodiment of the invention will be described in detail. This description applies equally to the other rolls having both an angular and an axial detecting structure. The best illustration of this structure used on several roll frames is for the frame used with roll 32 as shown in FIGS. 2 and 3. An outwardly projecting bar 120 is rigidly fixed onto the roll frame 52 at the shoulder **52*a* by a bracket 122. This bracket moves in both directions as roll frame 52 moves. It is essentially integral with frame 60. Bar 120 supports a means for creating a first abutment surface 130 facing in a transverse direction to gauge the amount of angular movement of frame 60 about axis a. A second means is provided for creating a second abutment surface 132 facing axially and used to gauge the exact position of frame 52 in a direction axially of axis a. First linear transducer 140 coacts with surface 130 to determine the angular position of frame 52. In a like manner, a second linear transducer 142 coacts with surface 132 for gauging the actual axial position of frame 52. Transducers 140, 142 are fixedly mounted with respect to the housing 12 by bracket 140***a*, 142*a*, respectively. This arrangement is employed for gauging the actual position of each upper roll frame 50 as these frames are moved within cylindrical cavities 60.

The outwardly spaced lower rolls 30, 34 are movable only in an angular position; therefore, they are provided with only a first abutment surface 150, best shown in FIG. 3. A bar 152 is rigidly secured to the appropriate roll frame 52 by brackets 154. The surface 150 coacts with linear transducer 160 in the same manner as transducer 140 coacts with surface 130 in the previously described structure.

Figure 4:
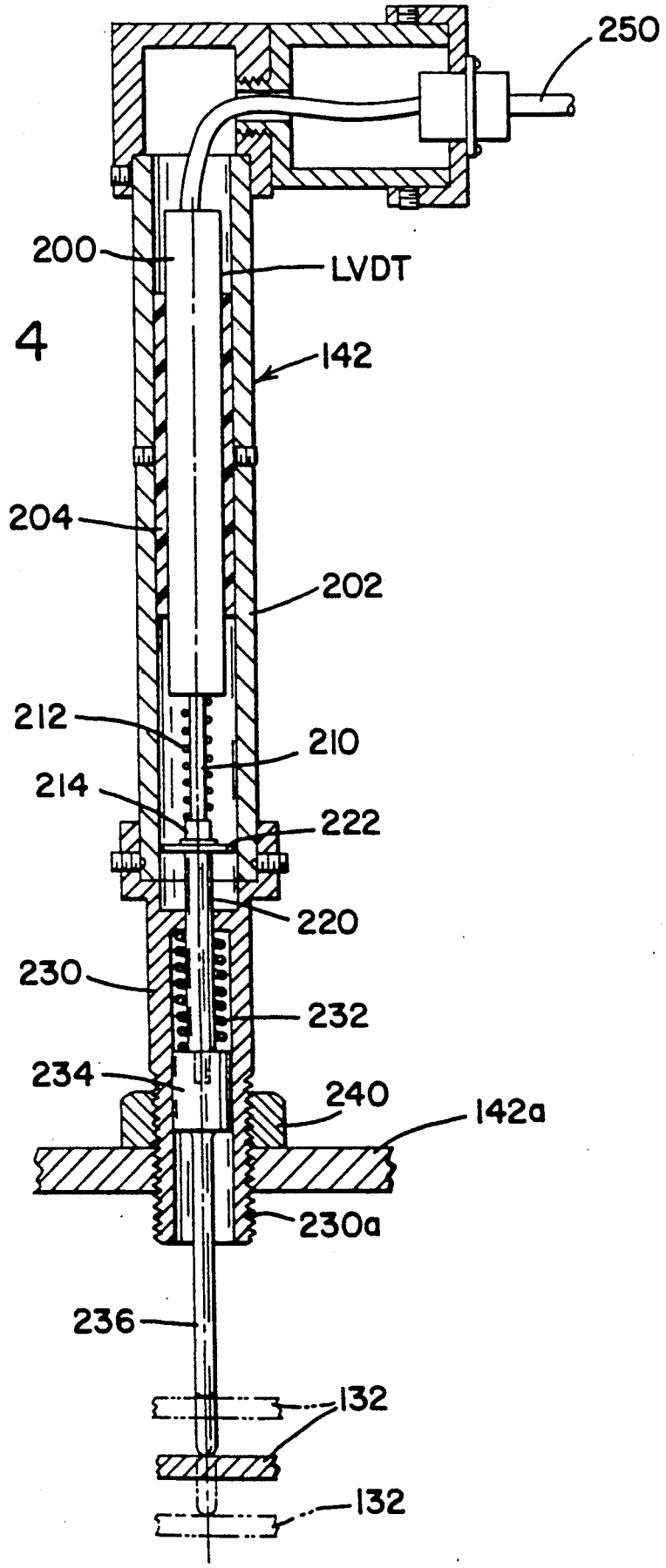
FIG. 4 is an enlarged cross sectional view showing the linear variable differential transformer type transducer and taken generally along line 4—4 of FIG. 2.
Figure 9:
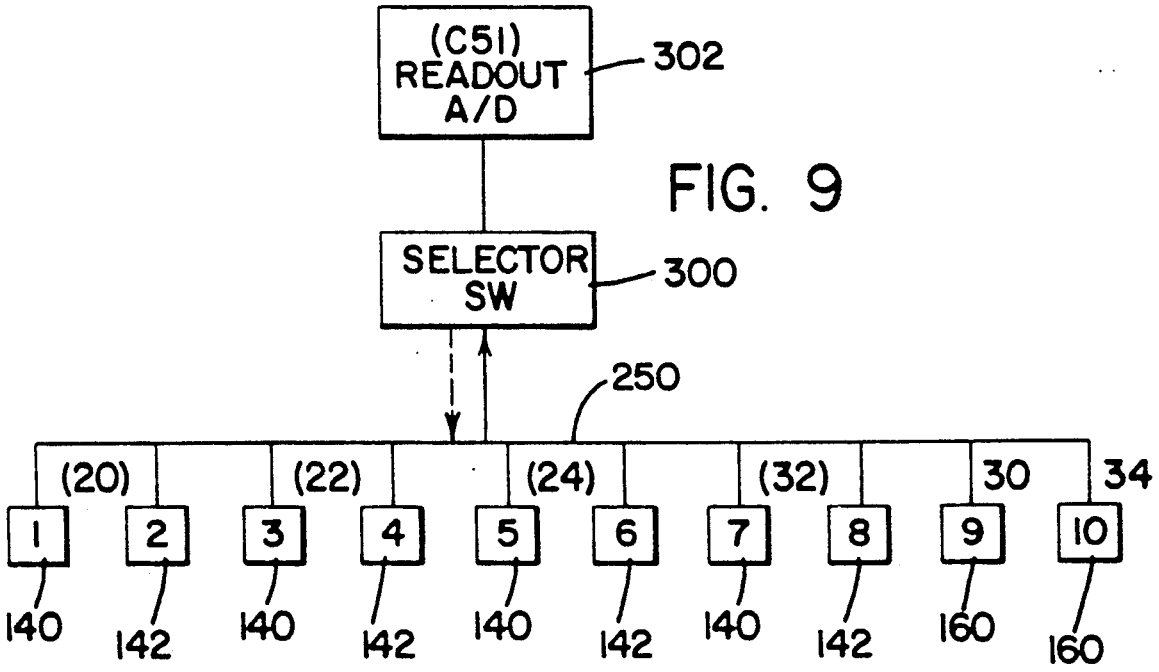

Linear transducers 140, 142 and 160 convert the position of the gauge surfaces 130, 132 and 150 into an output voltage. Transducer 142 is shown in detail in FIG. 4. This description applies equally to the other transducers 140 and 146. Transducer 140 coacts with movable surface 132 to determine the axial position of the center roll 22. In accordance with an aspect of the invention, the linear transducer employed in the invention is a linear variable differential transformer (LVDT) 200 as sold in various sizes by Schlumberger Industries. This linear transducer is usable with a digital indicator C51 for converting the voltage output of transducer 200 into a five digit digital number, as shown in FIG. 9. The linear variable differential transformer transducer 200 is supported in tube 202 by a plastic sleeve 204. The movable member of this transducer, i.e. reciprocal member 210, is biased outwardly by spring 212 so that indicator tip 214 engages plunger 220 at upper head 222. Tip 214 rides on head 222; therefore, there is no tendency to cause lateral movement of indicator tip 214 by plunger 220 as it is reciprocated within housing 230. Threads 230*a* lock transducer 142 onto bracket 142*a*. Spring 232 engages shoulder 234 to bias finger 236 outwardly. In this manner, spring 212 maintains contact between head 222 and indicator tip 214. Spring 232 absorbs any shock created by rapid movement of gauge surface 132. Nut 240 locks transducer 142 in the desired adjusted position on bracket 142*a*. This same type of mounting structure is employed for the remaining transducers used on straightener A; however, the transducers may be of a different size if desired. Output lead 250 provides both the input primary voltage for the transformer forming transducer 42 and the output secondary voltage indicative of the exact position of indicator tip 214.

In FIG. 9, the output leads 250 from the several transducers are multiplexed through a selector switch 300 to an appropriate readout analog to digital converter 302. An operator can set selector switch 300 to read one position of a roll frame. All measured positions are, thus, read in sequence by the display on readout device 302. This device is a digital display of the type needed by the digital indicator C51 manufactured and sold by Schlumberger Industries. After an operator has determined the proper settings of all transducers for a given product, the readouts of all transducers at readout device 302 are recorded. When this same product is run again, selector switch 300 is moved to read all positions. The position of the roll frame is adjusted until the readout conforms to the desired digital readout. This procedure is repeated for all transducer inputs. Consequently, the exact positions of the roll frames are duplicated for a subsequent run. Of course, an appropriate automatic recording scheme could be used with this system. As indicated by the dashed lines an automatic closed loop system can be used to adjust all settings until they reach the desired previously recorded positions for a given product.

In FIGS. 7 and 8, a modification of the system and method is illustrated. This modification could be employed for use with a newly manufactured rotary straightener. Of course, this modification could be employed for retrofitting an existing straightener; however, the first embodiment illustrated in FIGS. 1–4 is preferred for retrofitting. In the embodiment illustrated in FIGS. 7 and 8, the means for creating an abutment surface facing in a transverse direction is a machined notch in roll frame 50. This notch defines a flat transversely facing surface 332 that coacts with the finger 236 of transducer 330. This transducer has a threaded base 332 which mounts the transducer in bore 334 of housing 10, as best shown in FIG. 8. A lock nut 336 holds the transducer in a fixed position on housing 10. The upper surface 340 of roll frame 50 forms the axially facing abutment surface for this second embodiment of the invention. Surface 340 coacts with finger 236 of transducer 350 having the threaded base 352 that holds the transducer into bore 354 of frame 10. Nut 356 locks transducer 350 in place. Transducers 330 and 350 are linear variable differential transformer type transducers that coact with the surface on frame 50 to provide exact positional information for subsequent use in adjusting the position of the frame in both an angular and axial direction. The arrangement employed in FIGS. 7 and 8 can be used for each roll frame 50, 52 to produce a transducer network as illustrated in FIG. 9 for use in adjusting each of the rolls to the desired position for subsequently processing a workpiece in accordance with previously created set up information.

Having thus defined the invention, the following is claimed:

1. A method of resetting the angularly adjustable cross rolls, and selected axially adjustable ones of the said cross rolls of a rotary tube straightener, for straightening new tube products as they are passed through the straightener along a given feed path between opposed pairs of the said cross rolls supported in respective support frames rotatively and axially mounted in a fixed housing for angular and axial movement relative thereto about respective parallel central axes, the said frames each being provided with an axially facing abutment surface and an angularly facing abutment surface relative to the respective said central axis and the housing being provided with means for directly measuring the axial and the angular positions of the said abutment surfaces relative to the said fixed housing, which method comprises the step of reset adjusting the angular and axial operating positions of the said adjustable cross rolls until the said direct measurements of the positions of the said abutment surfaces relative to the fixed housing equal respective predetermined known values.

2. A method as defined in claim 1, wherein the said directly measuring means provides respective digital indications of the instantaneous angular and axial operating positions of the said cross rolls, which method comprises the step of reset adjusting the angularly and axially operating positions of the said adjustable cross rolls until the said digital indications of their respective instantaneous angular and axial operating positions equal respective predetermined known values.

3. A method as defined in claim 2, wherein the said step of reset adjusting the angular and axial operating positions of the said adjustable cross rolls is performed manually.

4. A method as defined in claim 2, wherein said angularly adjustable cross rolls are fixed into position once said cross rolls have been reset to their respective positions.

5. A method as defined in claim 2, wherein said axially adjustable cross rolls are fixed into position once said cross rolls have been reset to their respective positions.

6. A method as defined in claim 1, wherein the said directly measuring means provides respective digital readout numbers on a digital readout device indicative of the instantaneous angular and axial operating positions of the said cross rolls, which method comprises the step of reset adjusting the angular and axial operating positions of the said adjustable cross rolls until the said digital readout numbers indicative of their respective instantaneous angular and axial operating positions equal respective predetermined known values.

7. A method as defined in claim 6, wherein the said step of reset adjusting the angular and axial operating positions of the said adjustable cross rolls is performed manually.

8. A method as defined in claim 6, wherein said angularly adjustable cross rolls are fixed into position once said cross rolls have been reset to their respective positions.

9. A method as defined in claim 6, wherein said axially adjustable cross rolls are fixed into position once said cross rolls have been reset to their respective positions.

10. A method as defined in claim 1, wherein the said step of reset adjusting the angular and axial operating positions of the said adjustable cross rolls is performed manually.

11. A method as defined in claim 1, wherein said angularly adjustable cross rolls are fixed into position once said cross rolls have been reset to their respective positions.

12. A method as defined in claim 1, wherein said axially adjustable cross rolls are fixed into position once said cross rolls have been reset to their respective positions.

13. A system for setting the exact operative position of the cross rolls with respect to the fixed housing of a rotary straightener for straightening an elongated new workpiece as it travels through the straightener along a given path, said straightener having a number of concavely contoured cross rolls divided into a first group of rolls extending axially along one side of said path and a second group of rolls matching said first group and extending axially along a second side of said path opposite to said first side, each of said cross rolls being rotatively mounted on a cylindrical roll frame with a central axis and carried in a cylindrical, concentric cavity in said housing of said straightener whereby said rolls are each adjustable angularly about said central axis by rotating each roll frame in said cavity and selected ones of said rolls are adjustable axially along said central axis by translating said roll frames in said cavity, said system comprising: abutment surface means located directly on said roll frames and movable in a given direction with respect to said central axis as said roll frame is adjusted in said cavity, detecting means on said housing engaging with the said abutment surface means on said roll frames for directly measuring the positions of the said abutment surfaces on said roll frames relative to said housing to thereby indicate the instantaneous operating positions of the adjustable cross rolls with respect to their respective said central axis, and means for reset adjusting the positions of said adjustable cross rolls with respect to their respective said central axis until the said direct measurements of the said positions of each said abutment surface means equal a respective predetermined known value.

14. A system as defined in claim 13, wherein the said abutment surface means on each said roll frame includes both a transversely facing surface and an axially facing surface thereon, and the said detecting means includes separate said detecting means engaging with respective ones of said transversely and axially facing surfaces to indicate the instantaneous axial and angular operating positions of the adjustable cross rolls with respect to their respective said central axis.

15. A system as defined in claim 14, wherein the said reset adjusting means is manually operative.

16. A system as defined in claim 13, wherein the said abutment surface means on each said roll support frame is a transversely facing surface thereon, and the said detecting means engage therewith to indicate the instantaneous axial operating position of the adjustable cross rolls with respect to their respective said central axis.

17. A system as defined in claim 16, wherein the said reset adjusting means is manually operative.

18. A system as defined in claim 13, wherein the said abutment surface means on each said roll support frame is an axially facing surface thereon, and the said detecting means engages therewith to indicate the instantaneous angular operating position of the adjustable cross rolls with respect to their respective said central axis.

19. A system as defined in claim 18, wherein the said reset adjusting means is manually operative.

20. A system as defined in claim 13, wherein the said detecting means produces digital indications of the instantaneous angular and axial operative positions of the adjustable cross rolls, and the said reset adjusting means is operative to adjust the angular and axial operating positions of the said adjustable cross rolls until the said digital indications of their respective said instantaneous angular and axial operating positions equal respective predetermined known values.

21. A system as defined in claim 20, wherein the said reset adjusting means is manually operative.

22. A system as defined in claim 13, wherein the said detecting means produces respective digital readout numbers on a digital readout device which are indicative of the instantaneous angular and axial operating positions of the adjustable cross rolls, and the said reset adjusting means is operative to adjust the angular and axial operating positions of the said adjustable cross rolls until the said digital readout numbers equal respective predetermined known values.

23. A system as defined in claim 22, wherein the said reset adjusting means is manually operative.

24. A system as defined in claim 13, wherein the said reset adjusting means is manually operative.

25. A method as defined in claim 13, wherein said angularly adjustable cross rolls are fixed into position once said cross rolls have been reset to their respective positions.

26. A method as defined in claim 13, wherein said axially adjustable cross rolls are fixed into position once said cross rolls have been reset to their respective positions.

* * * * *